US007882669B2

(12) United States Patent
Qu et al.

(10) Patent No.: US 7,882,669 B2
(45) Date of Patent: Feb. 8, 2011

(54) COMPOSITE CONCRETE SHEAR WALL FOR HEAT INSULATION

(76) Inventors: Ping Qu, Huaxia Bank West of City Branch, No. 1-8, Xikang Road, Nanjing, Jiangsu 210024 (CN); Xinfu Chen, No. 120-1, Shanghai Road, Gulou District, Nanjing, Jiangsu 210000 (CN)

( * ) Notice: Subject to any disclaimer, the term of this patent is extended or adjusted under 35 U.S.C. 154(b) by 335 days.

(21) Appl. No.: 12/089,782

(22) PCT Filed: Apr. 12, 2007

(86) PCT No.: PCT/CN2007/001188

§ 371 (c)(1),
(2), (4) Date: Apr. 10, 2008

(87) PCT Pub. No.: WO2007/134517

PCT Pub. Date: Nov. 29, 2007

(65) Prior Publication Data

US 2008/0282634 A1 Nov. 20, 2008

(51) Int. Cl.
*E04C 1/00* (2006.01)

(52) U.S. Cl. ..... 52/309.16; 52/407.4; 52/414; 52/415; 52/418

(58) Field of Classification Search ..... 52/309.11, 52/309.12, 309.15, 309.16, 309.17, 395, 52/402, 405.1–405.4, 407.1, 407.4, 414, 52/415, 418, 419, 428, 459, 506.08, 782.1
See application file for complete search history.

(56) References Cited

U.S. PATENT DOCUMENTS

| | | | | | |
|---|---|---|---|---|---|
| 2,653,469 | A | * | 9/1953 | Callan | 52/274 |
| 3,353,322 | A | * | 11/1967 | Guddal | 52/741.41 |
| 3,750,355 | A | * | 8/1973 | Blum | 52/309.12 |
| 4,348,847 | A | * | 9/1982 | Jukes | 52/426 |

(Continued)

FOREIGN PATENT DOCUMENTS

| | | |
|---|---|---|
| CN | 2594343 | 12/2003 |
| FR | 2598449 | 11/1987 |

*Primary Examiner*—Richard E Chilcot, Jr.
*Assistant Examiner*—Chi Nguyen
(74) *Attorney, Agent, or Firm*—Schmeiser, Olsen & Watts, LLP

(57) ABSTRACT

A composite concrete shear wall for heat insulation comprises a wall (1) and a link beam (2). The wall (1) is composed of a prefabricated concrete wall for heat insulation (11) and a cast-in-place concrete wall. The prefabricated concrete wall (11) is a concrete panel (5), one surface of which is covered with heat insulation layer (4), and steel members (14) are embedded in the prefabricated concrete wall (11). One end of the steel members is embedded in concrete panels, and the other is projected from the heat insulation layer. The steel members are connected and located along the prefabricated concrete wall to form a framework of steel reinforcement. The prefabricated concrete wall (11) and the cast-in-place concrete wall (12) are cast and folded to be an integral.

6 Claims, 3 Drawing Sheets

U.S. PATENT DOCUMENTS 4,393,635 A * 7/1983 Long ..... 52/309.11
4,545,163 A * 10/1985 Asselin ..... 52/378
4,624,089 A * 11/1986 Dunker ..... 52/410
4,702,053 A * 10/1987 Hibbard ..... 52/309.7
4,829,733 A * 5/1989 Long ..... 52/309.11
4,932,819 A * 6/1990 Almeras ..... 411/441
5,673,525 A 10/1997 Keith et al.
5,987,830 A * 11/1999 Worley ..... 52/309.11
5,996,297 A * 12/1999 Keith et al. ..... 52/410
2004/0068948 A1 4/2004 Wrass

* cited by examiner

1—1

2—2

COMPOSITE CONCRETE SHEAR WALL FOR HEAT INSULATION

TECHNICAL FIELD

The present invention relates to a type of concrete building, in particular a composite concrete shear wall for heat insulation.

BACKGROUND OF THE INVENTION

Existing high buildings are mostly concrete buildings. These include frame-shear wall concrete building, frame-cylinder concrete building, fully shear wall concrete building, and cylinder-cylinder wall concrete building.

Present concrete buildings mostly adopt cast-in-place concrete structure system. Large amount of timber needs to be used to fabricate formwork, seriously exhausting forest resource and affecting environment and climate.

All cast-in-place concrete building structures adopt site construction involving high manual labor strength, low level of factory production, many sequences, high costs and long construction period.

Existing building energy conservation technology has been developed without changing existing building structure system. Heat insulation technology includes exterior wall exterior heat insulation and exterior wall interior heat insulation. In the former technology, heat insulation layer is added on outdoor surface of exterior wall; in the latter technology, heat insulation layer is added on inner surface of exterior wall. In terms of material, heat insulation layer can be of plate material or slurry material. No matter plate or slurry, existing building exterior wall energy conservation technology has the apparent disadvantages of many sequences, high cost, poor effect, low safety, service life shorter than 15 years, and unsuitability on interior wall etc.

From nineteen forties to nineteen seventies, large concrete slab buildings appeared home and abroad. In such buildings, complete concrete wall slabs and floor slabs are used as basic members of building, so as to realize factory production and assembling installation. To save materials, large porous concrete slab building was invented in China; however, such building has poor overall performance and cannot satisfy comfort requirements as proven by practice.

SUMMARY

The purpose of the present invention it to provide a type of heat insulation shear wall for a self-heat insulated building structure system with high performance concrete structure material and high efficiency heat insulation material as main materials, to overcome aforesaid defects of existing technology provided that basic state policies of antiseismic properties, energy saving, land saving, environmental protection, no use of clay bricks, less use of wood formwork and saving of non-renewable resources are fully satisfied. This shear wall is suitable for factory production and mechanized construction, and safe, reliable and cheap. Service life reaches 50 years.

Technical scheme of this invention: A composite concrete shear wall for heat insulation, a wall and a link beam, characterized by the wall consisting of a prefabricated concrete wall for heat insulation and a cast-in-place concrete wall. The prefabricated concrete wall is a concrete panel, one surface of which is covered with a heat insulation layer, and steel members are embedded in the prefabricated concrete wall at certain spacing. One end of the steel members is embedded in the concrete panels, and the other end is projected from the heat insulation layer of the prefabricated concrete panel. The steel members are connected and located along the prefabricated concrete wall to form reinforcement cage of cast-in-place concrete wall. The prefabricated concrete wall and the cast-in-place concrete wall are cast and folded to be an integral.

The steel members can be T shaped and L shaped steel straps, or T shaped screw bolt (screw bolt of suitable length can be connected to screw bolt with inner bolt hole). Gaps are provided around steel members so that concrete can be filled in such gaps during site grouting of concrete wall to enhance shear strength between two concrete layers.

At intersection between the link beam and wall, the cast-in-place link beam is cast integral with upper and lower cast-in-place concrete layers. Outer end of link beam is covered with heat insulation layer.

At intersection between the link beam and wall, protruding teeth perpendicular to surface are provided on link beam and corresponding grooves are provided at lower end of prefabricated concrete panel to allow engagement of prefabricated concrete wall with the link beam below. At intersection between link beam upper end and prefabricated concrete panel lower end at two corners, steel plates and angles are embedded in link beam and prefabricated concrete panel respectively, and welded together for installation. At the other end of prefabricated concrete panel, connecting rebar perpendicular to end face are embedded, and will be connected to and fixed on reinforcement cage of cast-in-place link beam to form an integral part of such cage.

Concrete panel used for the prefabricated concrete wall adopts prestressed concrete or reinforced concrete. Material of the heat insulation layer can be polystyrene foam or other organic foam. Said cast-in-place concrete wall and floor adopt reinforced concrete.

In this invention, outer surface of prefabricated concrete panel used as wall is provided with ornamental motif or grooves for embedded pipelines, to replace additional (stuck) facing or avoid secondary cutting of grooves on wall surface, thereby saving investment and facilitating construction.

In this invention, prefabricated concrete wall for heat insulation is used as permanent formwork on outer surface of wall and serves as formwork during construction. Up on completion of construction, this prefabricated wall will constitute part of folded shear wall and bear part of the load. For grouting of concrete, structural measures of point connection can serve to fix formwork. When subject to load, coordinated operation of permanent formwork with composite layer and superposed layer grouted later can be ensured. Point connection mode can reduce cold (hot) bridge to a minimum, thereby increasing heat insulation efficiency of superposed wall.

Beneficial effect of this invention also lies in that this invention provides a new energy saving building system, in which (factory) prefabricated concrete wall for insulation is used as exterior wall and household division wall, and also used as formwork for cast-in-place concrete part. This formwork needs not be removed and constitutes a permanent part of concrete wall structural system for heat insulation. With this technology, heat insulation performance of cast-in-place concrete building structure system has been improved, in line with development trend of building energy conservation. In addition, construction sequences have been reduced, and construction period shortened, reducing cost and solving the problem of complicated process of energy saving buildings.

This invention favors integrated design, modular production and installation, improved construction quality and accurate control of construction period. In addition, dry site operation can be performed, realizing factory fabrication of concrete buildings.

With this invention, buildings can more easily meet energy conservation standard, and obtained improved sound insulation and heat insulation performance. No separate heat insulation layer is required for the walls, hence room yield rate is high and secondary fitment is favored.

1—wall 2—link beam 4—heat insulation layer 5—concrete panel 11—prefabricated concrete wall for heat insulation 12—cast-in-place concrete wall 14—steel member 15—screw bolt 16—screw bolt with inner bolt hole 17—connecting rebar 21—protruding tooth 22—steel plate embedded in link beam 51—groove 52—steel angle embedded in prefabricated concrete panel

DETAILED DESCRIPTION

Figure 1:
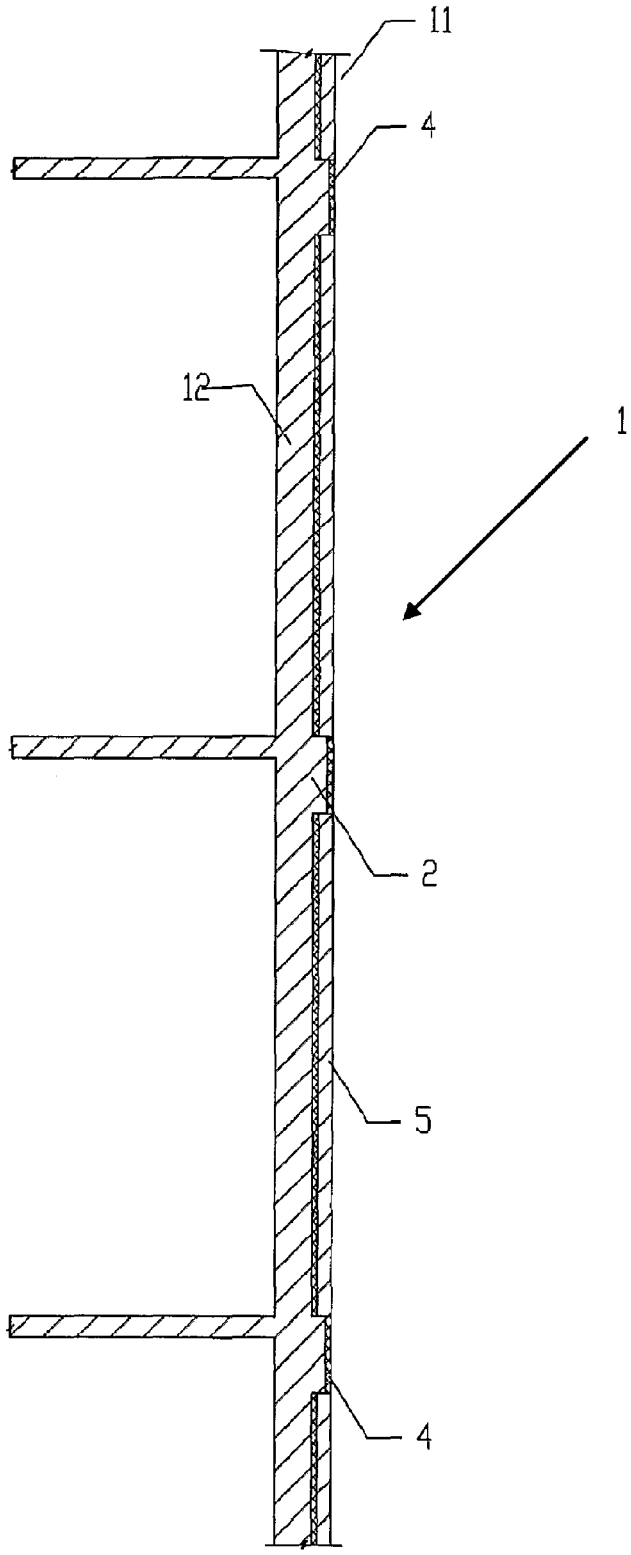
FIG. 1 is a schematic of shear wall structure of preferred embodiment 1 of this invention.

Refer to FIG. 1, a type of composite concrete shear wall for heat insulation, comprising wall 1 and link beam 2. Said wall 1 consists of prefabricated concrete wall 11 for heat insulation and cast-in-place concrete wall 12. Prefabricated concrete wall 11 for heat insulation is a concrete panel 5 with heat insulation layer 4 on its inner surface. Heat insulation layer 4 in prefabricated concrete wall 11 for heat insulation and cast-in-place concrete wall 12 are cast to be an integral. At connection between link beam 2 and wall 1, cast-in-place link beam 2 and upper/lower cast-in-place concrete wall 12 are cast to be an integral. Outer end face of link beam 2 is covered with heat insulation layer 4.

Figure 2:
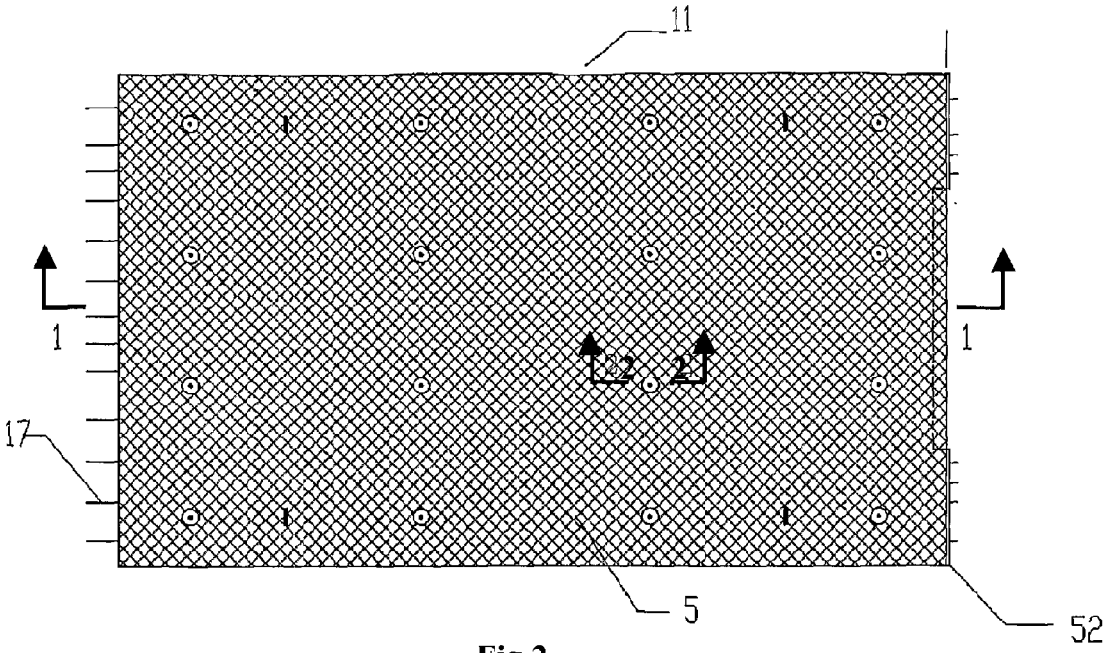
FIG. 2 is a schematic of structure of prefabricated concrete layer for heat insulation of preferred embodiment 1 of this invention.
Figure 3:
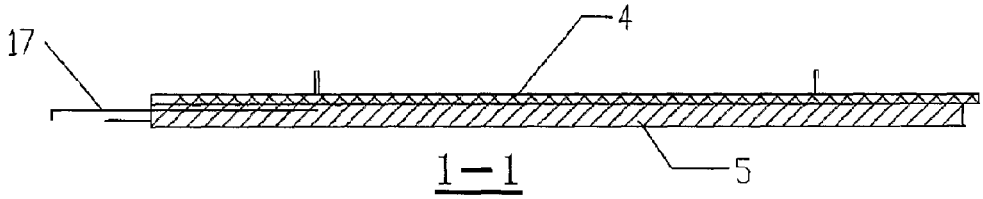
FIG. 3 is 1-1 section of FIG. 2.
Figure 4:
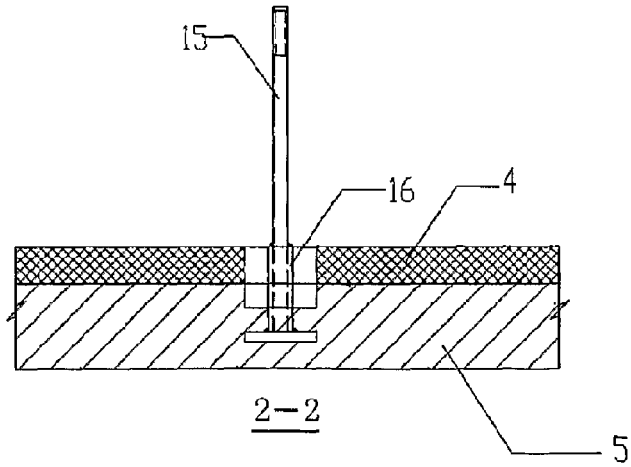
FIG. 4 is 2-2 section of FIG. 2.

Refer to FIG. 2, FIG. 3 and FIG. 4. In prefabricated concrete wall 11 for heat insulation, screw bolts with inner bolt hole 16 are embedded at certain spacing. Screw bolt 15 is inserted in bolt hole 16, and is projected from the heat insulation layer 4 of the prefabricated concrete wall for heat insulation. Screw bolts 15 at one side of prefabricated concrete wall for heat insulation are connected together to constitute reinforcement cage of cast-in-place concrete wall. Around screw bolts with inner bolt hole 16, gaps are reserved. Connecting rebar 17 perpendicular to end face is embedded in upper end of prefabricated concrete panel.

Figure 5:
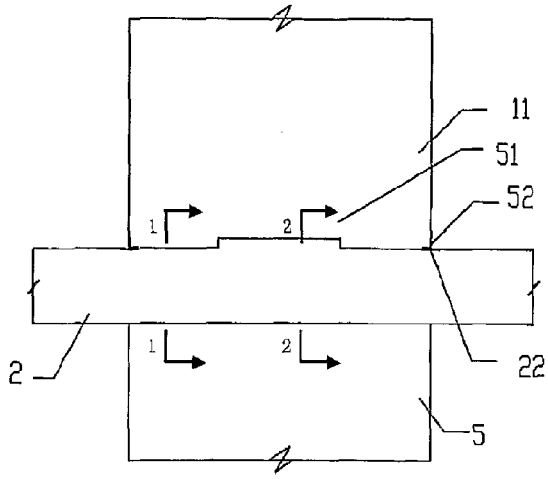
FIG. 5 is a schematic of structure of wall and link beam nodes of preferred embodiment 1 of this invention.
Figure 6:
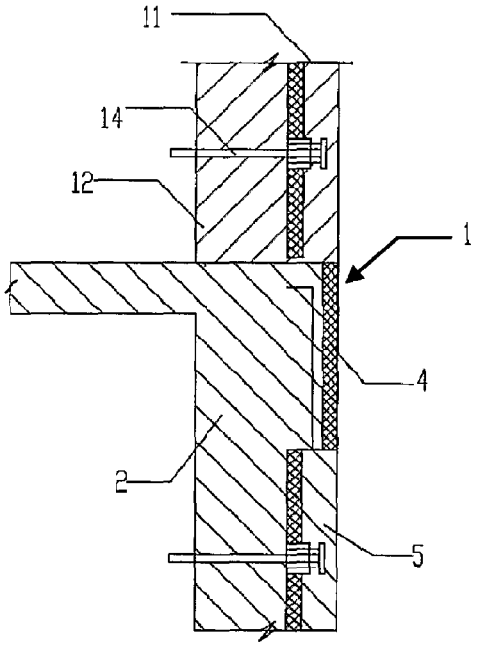
FIG. 6 is 1-1 section of FIG. 5.
Figure 7:
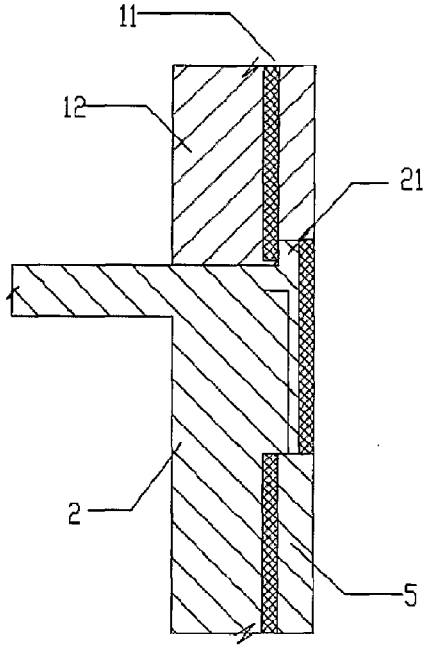
FIG. 7 is 2-2 section of FIG. 5.

Refer to FIG. 5, FIG. 6 and FIG. 7. At intersection between link beam 2 and wall 1, protruding teeth 21 perpendicular to surface are provided on link beam 2 and corresponding grooves 51 are provided at lower end of prefabricated concrete panel 5, so that prefabricated concrete wall for heat insulation is locked with protruding teeth 21 below via grooves 51. At intersection between link beam 2 upper end and prefabricated concrete panel lower end at two corners, steel plates 22 and angles 52 are embedded in link beam and prefabricated concrete panel respectively, and welded together for installation. Connecting rebar 17 is fixed on and connected to reinforcement cage of cast-in-place link beam 2 and connecting rebar 17 on prefabricated concrete panel constitutes part of reinforcement cage of cast-in-place link beam.

This invention is used in high concrete shear wall structural system.

The invention claimed is:

1. A composite concrete shear wall for heat insulation, comprising a wall and a link beam, wherein said wall further comprising a prefabricated concrete wall for heat insulation and a cast-in-place concrete wall; said prefabricated concrete wall being a concrete panel, one surface of which is covered with a heat insulation layer, and steel members are embedded in the prefabricated concrete wall at certain spacing; one end of said steel members is embedded in the concrete panels, and the other end is projected from the heat insulation layer of the prefabricated concrete panel; said steel members at one side of the prefabricated concrete wall are connected to form a reinforcement cage of the cast-in-place concrete wall; wherein said prefabricated concrete wall and the cast-in-place concrete wall are cast and folded to be an integral;

wherein the link beam is cast integral with the cast-in-place concrete wall and the prefabricated concrete wall, and an outer end of the link beam is covered with a heat insulation layer.

2. The concrete shear wall of claim 1, wherein the link beam is cast-in-place.

3. The concrete shear wall of claim 1, wherein outer surface of said prefabricated concrete wall for insulation is provided with ornamental motif or grooves for embedding of pipelines.

4. The concrete shear wall of claim 3, wherein at intersection between said link beam and wall, protruding teeth perpendicular to surface are provided on link beam and corresponding grooves are provided at lower end of prefabricated concrete panel to allow engagement of prefabricated concrete wall with the link beam below; at intersection between link beam upper end and prefabricated concrete panel lower end at two corners, steel plates and angles are embedded in link beam and prefabricated concrete panel respectively, and welded together for installation; and at the other end of prefabricated concrete panel, connecting rebar perpendicular to end face are embedded, and will be connected to and fixed on reinforcement cage of cast-in-place link beam to form an integral part of such cage.

5. The concrete shear wall of claim 1, wherein said steel members consist of screw bolts with inner bolt hole and screw bolts, said screw bolts with inner bolt hole are embedded in prefabricated concrete wall for heat insulation, said screw bolt is inserted into bolt hole of screw bolt with inner bolt hole and is projected from the heat insulation layer of the prefabricated concrete panel; and gaps are provided around screw bolt with inner bolt hole.

6. The concrete shear wall of claim 5, wherein at intersection between said link beam and wall, protruding teeth perpendicular to surface are provided on link beam and corresponding grooves are provided at lower end of prefabricated concrete panel to allow engagement of prefabricated concrete wall with the link beam below; at intersection between link beam upper end and prefabricated concrete panel lower end at two corners, steel plates and angles are embedded in link beam and prefabricated concrete panel respectively, and welded together for installation; and at the other end of prefabricated concrete panel, connecting rebar perpendicular to end face are embedded, and will be connected to and fixed on reinforcement cage of cast-in-place link beam to form an integral part of such cage.

* * * * *